US010245601B2

(12) United States Patent
Kohlhase

(10) Patent No.: US 10,245,601 B2
(45) Date of Patent: Apr. 2, 2019

(54) DEVICE FOR APPLYING A VISCOUS MATERIAL

(71) Applicant: Atlas Copco IAS GmbH, Bretten (DE)

(72) Inventor: Nils Kohlhase, Leonberg (DE)

(73) Assignee: Atlas Copco IAS GmbH, Bretten (DE)

( * ) Notice: Subject to any disclaimer, the term of this patent is extended or adjusted under 35 U.S.C. 154(b) by 1 day.

(21) Appl. No.: 15/512,867

(22) PCT Filed: Jul. 23, 2015

(86) PCT No.: PCT/EP2015/066841
§ 371 (c)(1),
(2) Date: Mar. 21, 2017

(87) PCT Pub. No.: WO2016/055179
PCT Pub. Date: Apr. 14, 2016

(65) Prior Publication Data

US 2017/0291180 A1 Oct. 12, 2017

(30) Foreign Application Priority Data

Oct. 7, 2014 (DE) ..... 10 2014 014 592

(51) Int. Cl.
*B05B 3/10* (2006.01)
*B05B 3/02* (2006.01)
*B05C 5/02* (2006.01)

(52) U.S. Cl.
CPC ..... *B05B 3/1035* (2013.01); *B05B 3/028* (2013.01); *B05C 5/0216* (2013.01); *B05B 3/02* (2013.01); *B05B 3/026* (2013.01)

(58) Field of Classification Search
CPC ..... B05B 3/1035; B05B 3/026; B05B 3/021; B05B 3/023; B05B 3/025; B05B 3/028; B05B 3/1042; B05C 5/02; B05C 5/0216
(Continued)

(56) References Cited

U.S. PATENT DOCUMENTS 3,094,254 A 6/1963 Cullen et al.
5,794,854 A * 8/1998 Yie ..... B05B 1/14 239/242

(Continued)

FOREIGN PATENT DOCUMENTS

DE 102 16 631 B4 2/2004
DE 10 2004 062063 A1 7/2006

(Continued)

OTHER PUBLICATIONS

International Search Report of PCT/EP2015/066841, dated Oct. 22, 2015.

(Continued)

*Primary Examiner* — Steven J Ganey
*Assistant Examiner* — Tuongminh N Pham
(74) *Attorney, Agent, or Firm* — Collard & Roe, P.C.

(57) ABSTRACT

A device for applying a viscous material includes an application tube which has a material inlet opening on a first end and a material outlet opening on a second end, which defines an application channel, and which is flexible at least over one portion of its length, and a housing which accommodates the application tube, and which has a material supply connection for the viscous material to the application tube, wherein the application tube is connected to the housing in an initial region coming from the material inlet opening, and is arranged at a distance to the housing in an end region extending to the material outlet opening, and wherein a bearing section of the end region is mounted near to the material outlet opening in a motor-driven eccentric that can rotate about the longitudinal central axis. An adjustment mechanism is provided for adjusting the distance of the bearing section to the longitudinal central axis.

18 Claims, 5 Drawing Sheets

Figure 1:
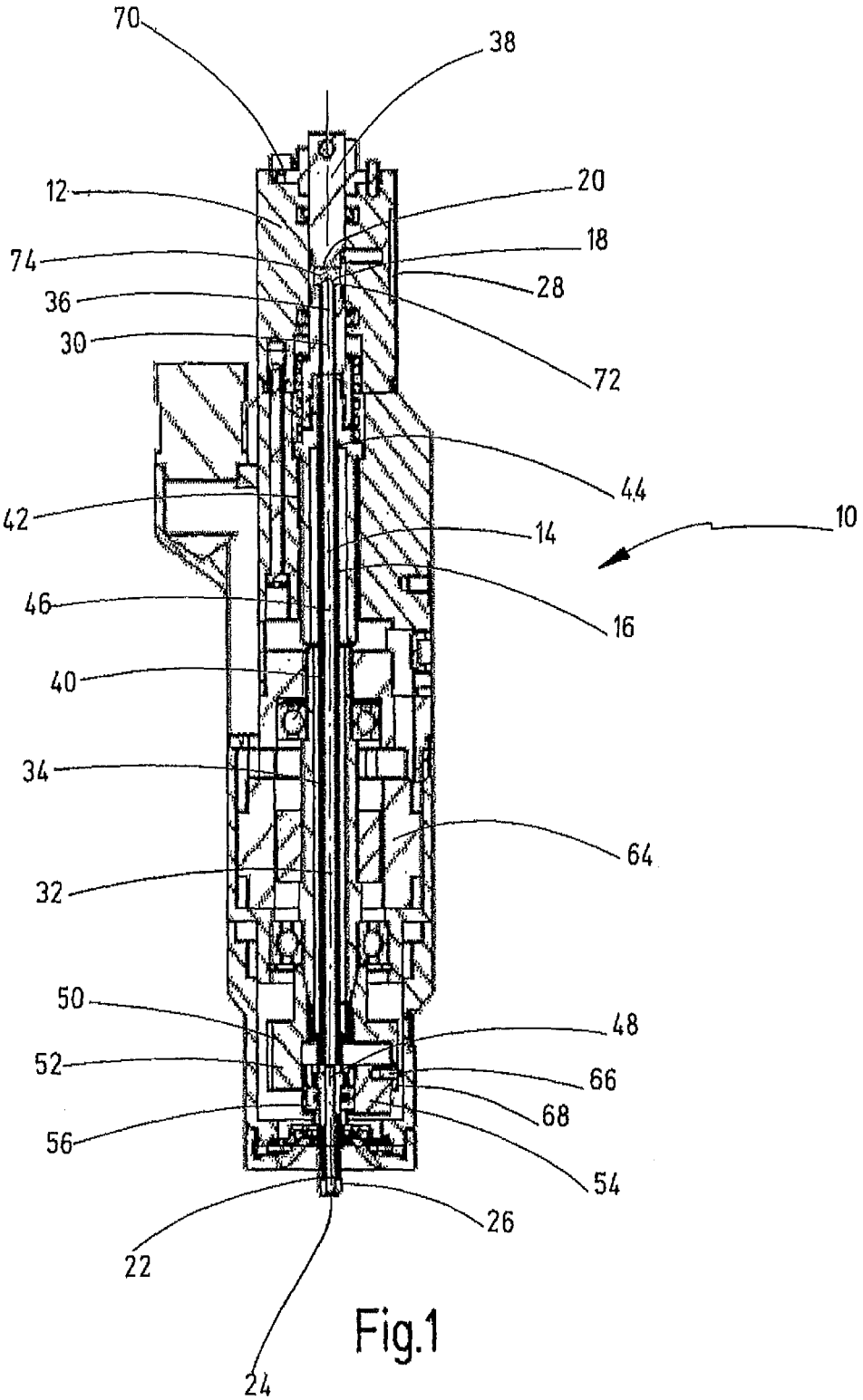

(58) Field of Classification Search
USPC ..... 239/227, 229, 242, 537; 222/504, 527, 222/509; 118/323
See application file for complete search history.

(56) References Cited

U.S. PATENT DOCUMENTS

| | | | | |
|---|---|---|---|---|
| 6,499,673 | B1 * | 12/2002 | Braun, Jr. | B05B 3/02 239/225.1 |
| 2002/0109017 | A1 * | 8/2002 | Rogers | B05B 3/00 239/227 |
| 2003/0066910 | A1 | 4/2003 | Romanin et al. | |

FOREIGN PATENT DOCUMENTS

| | | | |
|---|---|---|---|
| DE | 10 2010 006 067 | A1 | 9/2010 |
| DE | 10 2009 019 192 | A1 | 11/2010 |
| EP | 0 203 830 | A1 | 12/1986 |
| EP | 0 852 160 | B1 | 8/2003 |

OTHER PUBLICATIONS

German Search Report in DE 10 2014 014 592.1, dated Jun. 6, 2015, with English translation of relevant parts.

* cited by examiner

DEVICE FOR APPLYING A VISCOUS MATERIAL

CROSS REFERENCE TO RELATED APPLICATIONS

This application is the National Stage of PCT/EP2015/066841 filed on Jul. 23, 2015, which claims priority under 35 U.S.C. § 119 of German Application No. 10 2014 014 592.1 filed on Oct. 7, 2014, the disclosure of which is incorporated by reference. The international application under PCT article 21(2) was not published in English.

The invention relates to an apparatus for application of a viscous material.

Such apparatuses are known from EP 0 852 160 B1, for example, and are widely used in the application of viscous materials to workpieces, for example in the application of adhesive to car body parts. In this regard, an application tube from the material outlet opening of which the viscous material is applied to the workpiece, is mounted in an eccentric close to the end of the tube, which eccentric is put into rotation about its longitudinal center axis during the application process and imposes a circular movement on the eccentrically mounted application tube at its tip that has the material outlet opening. This circular movement, which takes place at multiple thousand revolutions per minute, causes centrifugal forces to act on the viscous material, which forces lead to a spiral-shaped movement of the material jet. This brings about circular material application and leads to a width of the applied material strand that is significantly greater than the diameter of the material outlet opening. For this purpose, this application tube must be elastically flexible over at least part of its length. However, the fact that variation of the profile of the applied material strand is possible only in limited manner by way of variation of the speed of rotation of the eccentric or, depending on the material, by way of the volume stream or the distance of the nozzle from the workpiece, something that is furthermore rather imprecise, is criticized as being disadvantageous.

It is therefore the task of the invention to improve an apparatus of the type stated initially, in such a manner that the profile of an applied material strand can be varied better.

This task is accomplished, according to the invention, by means of an apparatus having the characteristics described herein. Advantageous further developments of the invention are also described herein.

The invention is based on the idea of achieving a change in the application profile by means of variation of the eccentricity of the eccentric in which the application tube is mounted. The region of the application tube that is mounted in the eccentric, which tube is elastically flexible at least in certain sections, is referred to as the mounting section hereinafter. The variation in eccentricity takes place, according to the invention, by means of an adjustment mechanism by means of which the distance of the mounting section from the longitudinal center axis can be adjusted.

It is practical if variation in the eccentricity is made possible in that the eccentric is configured in two parts, with an outer body that can be driven by a motor and an inner body that is accommodated in the outer body outside of its center, which body is entrained by the outer body as it rotates. The mounting section of the application tube is mounted in the inner body by means of a pivot bearing, so that it does not rotate along with the eccentric as it rotates. In this regard, it is preferred that the inner body can be moved between two end positions with reference to the outer body, which positions define a minimal and a maximal eccentric position of the mounting section with reference to the longitudinal center axis. In this regard, the minimal eccentric position can define an eccentricity of the mounting section of zero, so that material application takes place without circular material distribution. According to a first embodiment, the inner body is accommodated in the outer body outside of its center and can be rotated with reference to the outer body, so that rotation brings about a change in the eccentricity of the mounting section of the application tube. In this regard, it is practical if the eccentric has a rotation mechanism for rotation of the inner body with reference to the outer body, which mechanism has a journal that is guided in a guide motion link and projects radially, wherein the guide motion link essentially has the form of a spiral section. In this regard, the journal is preferably guided in the guide motion link between two end stops, which define two end positions of the inner body with reference to the outer body. Compulsory guidance of the journal in the spiral-section-shaped guide motion link allows conversion of a translational movement into a rotational movement. If the inner body is moved in the direction of the center longitudinal axis with reference to the outer body, rotation of the two bodies relative to one another necessarily takes place, which brings about a variation in the resulting eccentricity. This is particularly advantageous if the application tube is mounted so as to be axially non-displaceable in the inner body and with limited axial displaceability in the housing, so that rotation of the inner body with reference to the outer body can take place by way of a displacement of the application tube in the direction of the longitudinal center axis. In this regard, the journal is firmly connected with the inner body according to a preferred exemplary embodiment, and the guide motion link is disposed on the outer body. It is not only possible for displacement of the application tube parallel to the longitudinal center axis to be restricted by the end stops of the guide motion link but also for the application tube to be displaceable in the housing by a displacement path that is smaller than the distance between the end stops of the guide motion link measured in the axial direction, so that this displacement path defines the maximal displaceability of the application tube.

It is practical if the inner body can be rotated relative to the outer body about an axis of rotation having a distance from the longitudinal center axis that is equal to its distance from the center axis of the mounting section. In this manner, a minimal resulting eccentricity of zero can be adjusted.

According to a second embodiment, the inner body can be linearly displaced relative to the outer body in a direction transverse to the longitudinal center axis. In this regard, it is possible that the outer body has a guide channel inclined at an acute angle relative to the longitudinal center axis, in which channel the inner body is accommodated. Displacement of the inner body in the guide channel then brings about a change in eccentricity. This displacement can once again take place in that the application tube is mounted in the inner body so as to be axially non-displaceable and in the housing with limited axial displaceability. According to an alternative variant, the eccentric has a displacement mechanism for displacement of the inner body with reference to the outer body, which mechanism has a journal that is guided in a guide motion link and projects radially, wherein the guide motion link is inclined at an acute angle relative to the longitudinal center axis. In this regard, the guide motion link can be disposed in a slide that can be displaced parallel to the longitudinal center axis, so that its displacement in the axial direction brings about displacement of the inner body in the radial direction and thereby a change in eccentricity.

It is practical if a ring groove that runs around the application tube and extends for a certain distance in the longitudinal direction of the application tube is provided, which groove opens into a transverse bore that leads to the application channel and into which groove the material feed connector empties. This allows reliable feed of the material into the housing, into the application channel, even if the application tube is displaced in its longitudinal direction. It is practical if the ring groove extends over a length of the application tube that is greater than the displacement path by which the application tube is displaceable, particularly over a length that is at least twice, preferably at least three times as great as the displacement path.

For minimization of friction, it is practical if the pivot bearing is a ball bearing. It preferably has an inner ring firmly connected with the application tube and an outer ring firmly connected with the inner body, between which rings the balls are disposed.

According to an advantageous further development, at least a part of the initial region of the application tube is accommodated in a guide sleeve accommodated in the housing in torque-proof manner and connected with this sleeve. This part of the application tube is then not deformed during rotation of the eccentric. The application tube or the section of the application tube in question forms a structural unit with the guide sleeve, so that production is simplified. In this regard, it is preferred that the guide sleeve extends at least a certain distance along the end region and is disposed radially at a distance from this region, so that even when the eccentric rotates and the application tube is deflected as a result, no contact takes place between the guide sleeve and the end region. Furthermore, it is preferred that the inside diameter of the guide sleeve increases continuously in a transition region between the initial region and the end region, in order to avoid a notch effect in this region due to clamping of the application tube in the guide sleeve.

Figure 2B:
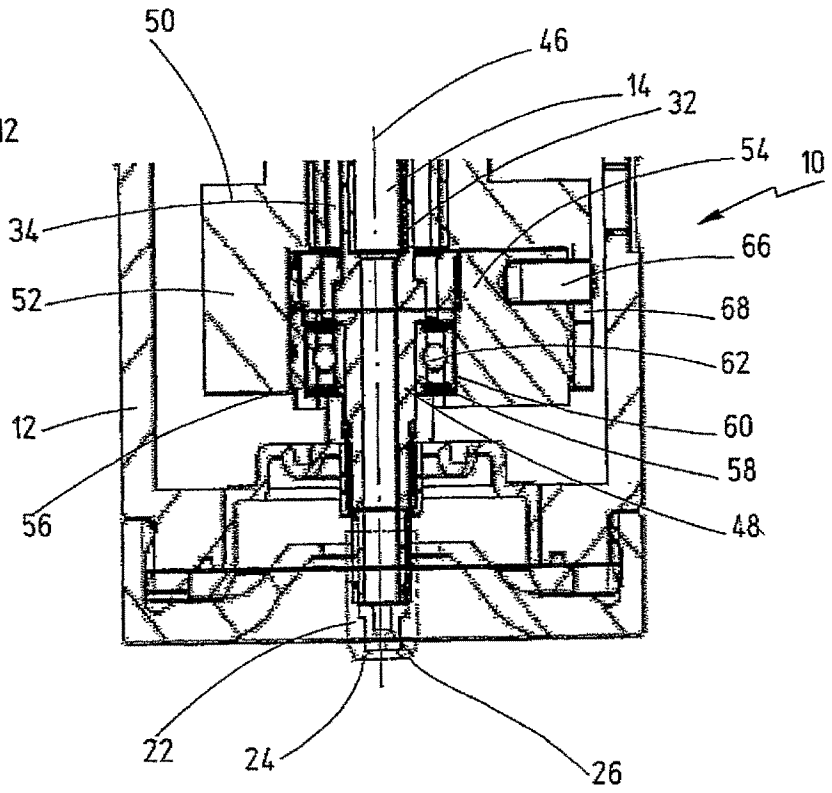
Figure 2A:
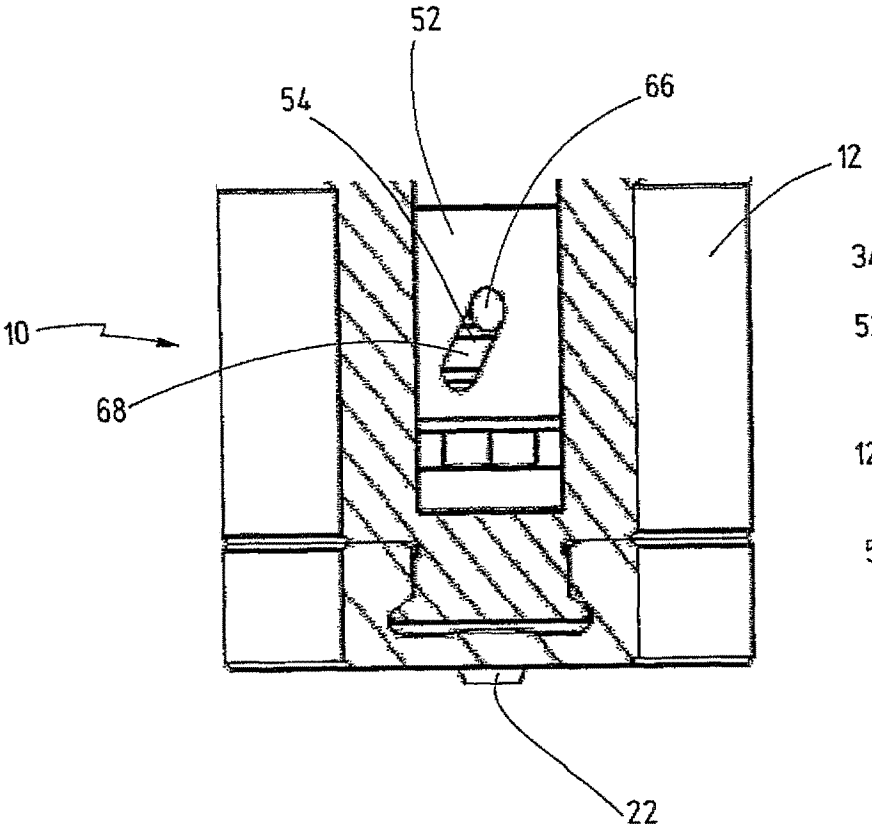
Figure 3B:
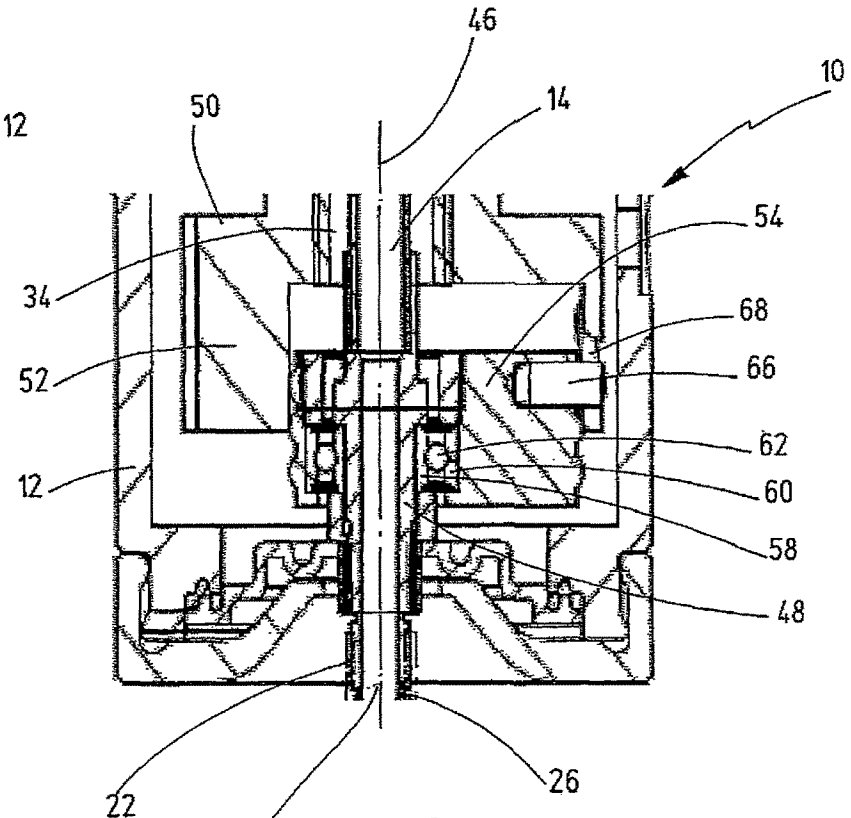
Figure 3A:
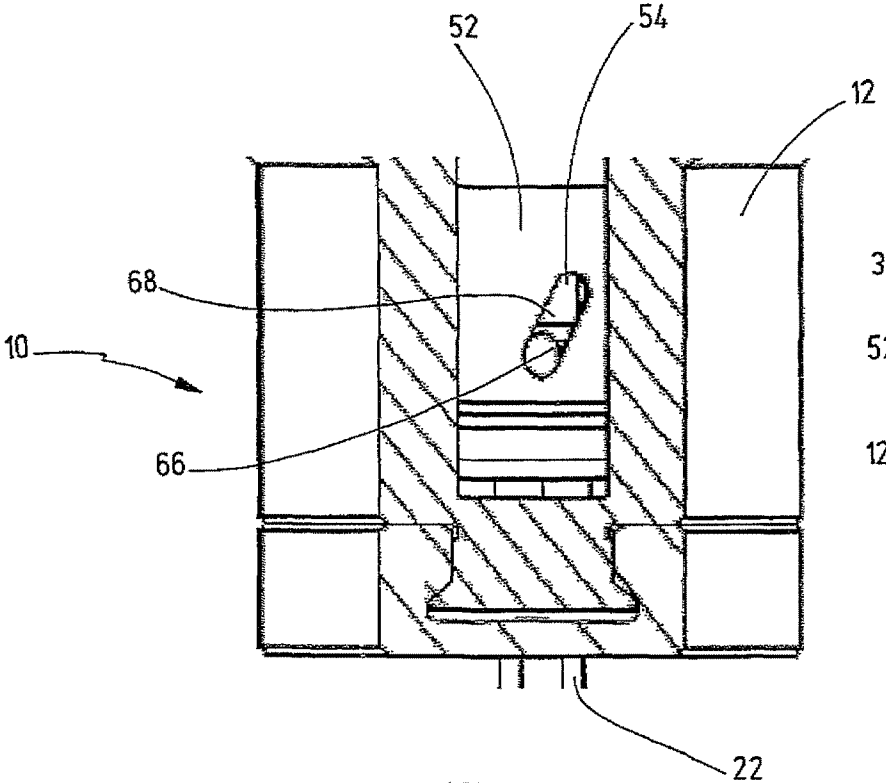
Figure 4:
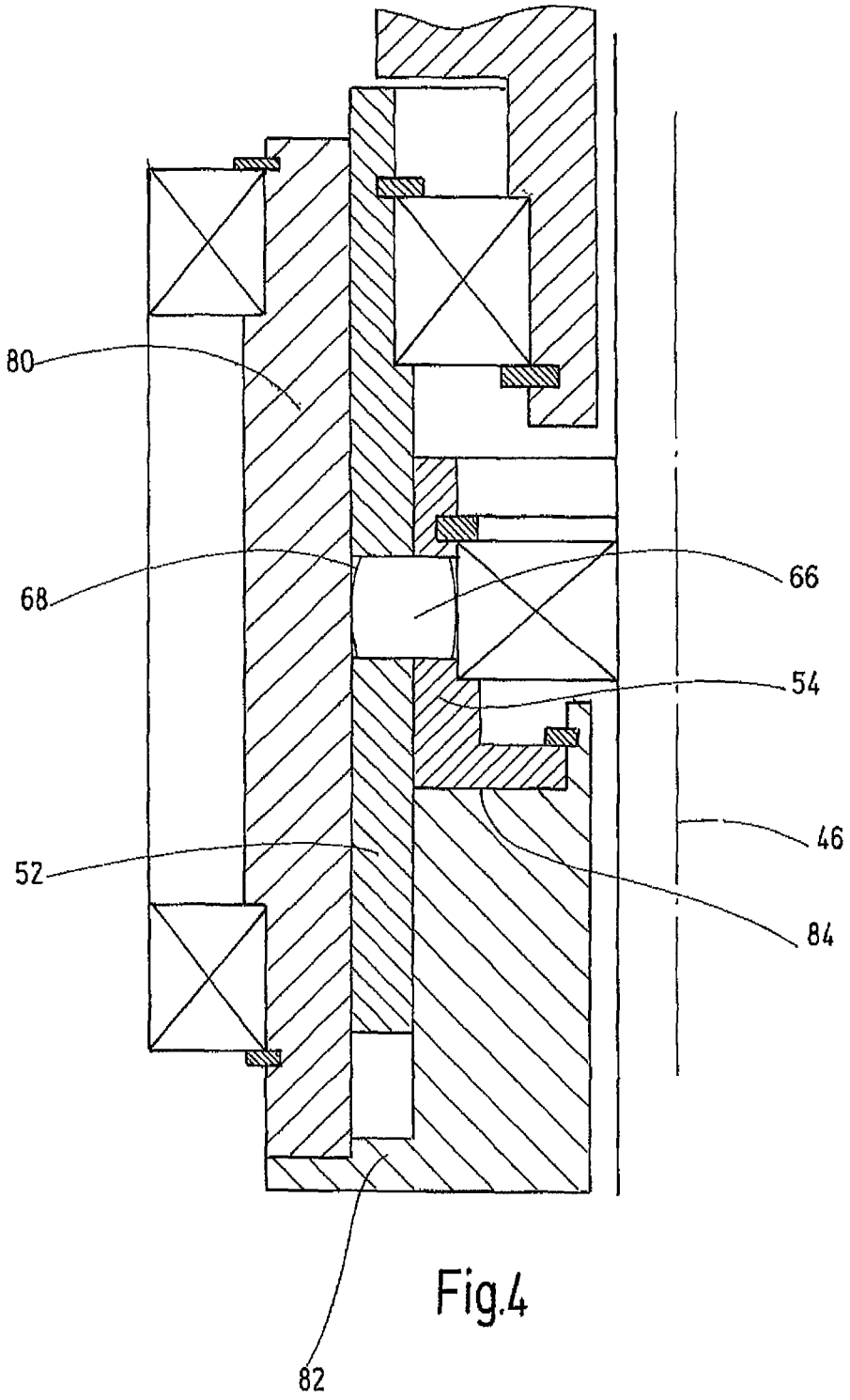
Figure 6:
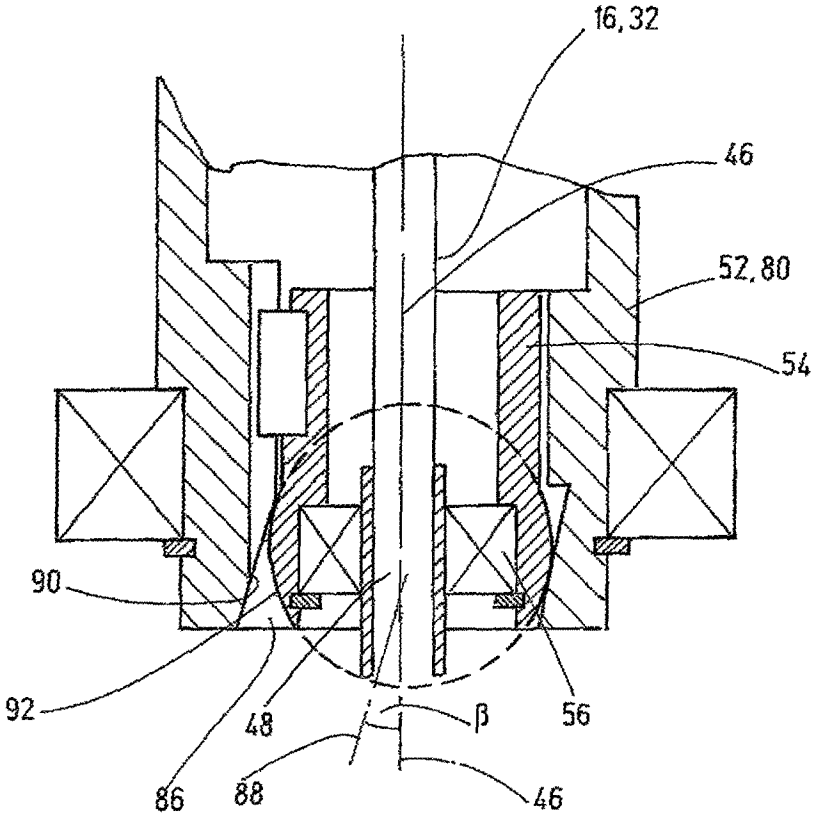
Figure 5:
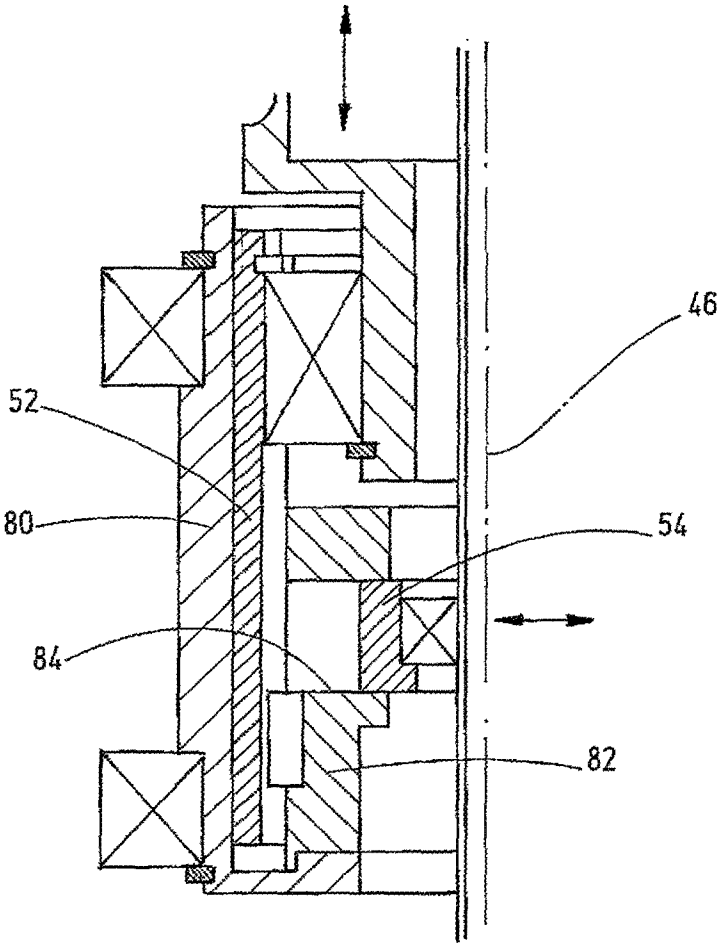

In the following, the invention will be explained in greater detail using the exemplary embodiments shown schematically in the drawing. The figures show:

FIG. 1 an apparatus for application of a viscous material, in longitudinal section, with a minimally eccentric position of the mounting section;

FIG. 2*a*, 2*b* detail representations of the apparatus according to FIG. 1, from two viewing directions perpendicular to one another, with a minimally eccentric position of the mounting section;

FIG. 3*a*, 3*b* detail representations of the apparatus according to FIG. 1, from two viewing directions perpendicular to one another, with a maximally eccentric position of the mounting section;

FIG. 4 to 6 detail representations of an application apparatus according to a second, a third, and a fourth exemplary embodiment.

The apparatus 10 shown in the drawing serves for application of a viscous material, for example an adhesive, to a workpiece. It has a housing 12 in which an application tube 16 that encloses an application channel 14 for the viscous material all around is accommodated. The application tube 16 is configured in multiple parts and extends from a first end 20 having a material inlet opening 18 all the way to a second end 26 formed by an application nozzle 22 having a material outlet opening 24. The viscous material is supplied to the material inlet opening 18 by way of a material feed connector 28 in the housing 12. The application tube 16 has an initial region 30 that proceeds from the first end 20, which region is connected with the housing 12, as well as an end region 32 that extends to the second end 26, which region is disposed at a distance from the housing 12 and is enclosed by a ring gap 34 over the major portion of its length. The initial region 30 is partially formed by a first tube section 36, which is followed by an extension 38 that projects out of the housing 12. In the other direction, the first tube section 36 is followed by an elastically flexible steel tube 40, which carries the application nozzle 22 at its end. In its section that belongs to the initial region 30, the steel tube 40 is accommodated in a guide sleeve 42 that is accommodated in the housing 12 in torque-proof manner. In a transition region 44 disposed between the initial region 30 and the end region 32, the distance between the guide sleeve 42 and the steel tube 40 increases continuously, until the ring gap 34 has reached its full width. The initial region 30 furthermore defines a longitudinal center axis 46 that runs centrally through it.

The application tube 16, in its end region 32, has a mounting section 48 that is mounted in an eccentric 50 that is disposed in the housing 12 so as to rotate about the longitudinal center axis 46 and can be driven by a motor. The eccentric 50 has an outer body 52 in which an inner body 54 is accommodated outside of the center, in which inner body, in turn, the mounting section 48 is mounted by means of a pivot bearing 56 configured as a ball bearing. The ball bearing 56 has an inner ring 58 that is firmly connected with the mounting section 48, an outer ring 60 that is firmly connected with the inner body 54, and balls 62 disposed between the inner ring 58 and the outer ring 60.

The mounting section 48 is moved between a minimally eccentric position shown in FIG. 1, 2*a*, 2*b* and a maximally eccentric position shown in FIG. 3*a*, 3*b* by means of rotation of the inner body 54 relative to the outer body 52, wherein the steel tube 40 is bent. In the minimally eccentric position, the mounting section 48 has an eccentricity of zero in the exemplary embodiment shown here, so that the longitudinal center axis 46 also forms the center axis of the end region 32. The greater the resulting eccentricity predetermined by the outer body 52 and the inner body 54, the greater the bending of the center axis of the end region 32. The greatest deviation from the longitudinal center axis 46 is situated at the material outlet opening 24. Rotation of the eccentric 50 about the longitudinal center axis 46 by application of an electric motor 64 to the outer body 52, at a typical speed of rotation of several thousand revolutions per minute, leads to movement of the material outlet opening 24 on a circular path, as a function of the eccentricity of the mounting section 48 that has been set, so that the viscous material exiting from the opening is swirled up on the basis of centrifugal forces and distributed over a significantly greater width than would be the case without rotation of the eccentric 50 or at an eccentricity of the mounting section 48 of zero. The greater the resulting eccentricity of the mounting section 48, the greater the circular movement of the viscous material and thereby the application width.

For adjustment of the eccentricity, the inner body 54 is provided with a radially projecting journal 66 that engages into a spiral-shaped guide motion link 68 in the outer body 52. The application tube 16 is furthermore disposed in the housing 12 so as to be longitudinally displaceable in the direction of the longitudinal center axis 46, for one thing, and for another, it is accommodated in the inner body 54 so as to be non-displaceable in the axis direction. Displacement of the application tube 16 in the housing 12, which is achieved, in the present exemplary embodiment, by means of rotation at the extension 38 on the basis of a worm gear mechanism 70, carries the inner body 54 along in the axial direction, wherein furthermore, rotation of the inner body 54 relative to the outer body 52 takes place on the basis of guidance of the journal 66 in the guide motion link 68. In this manner, the resulting eccentricity of the mounting section 48 can be easily adjusted manually. It is understood that such an adjustment can also take place by means of a motor drive.

In order to be able to reliably introduce the viscous material into the application channel 14 by way of the material feed connector 28, the application tube 16 is provided with a circumferential ring groove 72 in the region of the material feed connector 28, which groove extends a certain distance in the axial direction. The ring groove 72 opens into a transverse bore 74 that leads to the material inlet opening 18.

The application apparatuses according to the second, third, and fourth exemplary embodiment are shown in FIG. 4 to 6 merely in a detail representation and represented even more schematically than the application apparatus 10 according to the first exemplary embodiment. The same characteristics are provided with the same reference symbols.

The second exemplary embodiment shown in FIG. 4 differs from the first exemplary embodiment according to FIG. 1 to 3 essentially in that the inner body 54 is disposed so as to be axially non-displaceable, while the outer body 52 is disposed to be displaceable in the axial direction. A journal 66 projects radially away from the inner body 54, which journal is accommodated in a guide motion link 68 in the outer body 52, which link runs in spiral shape. In the second exemplary embodiment, axial displacement of the outer body 52 therefore leads to rotation of the inner body 54 accommodated outside of its center, in which inner body the mounting section 48 of the application tube 16, which once again is not shown in detail in FIG. 4, is accommodated. Rotation of the eccentric 50 is transferred by means of a rotor shaft 80 that encloses the outer body 52 all around, in certain sections, which shaft is connected with an inner shaft 82 on which the inner body 54 rests on a step 84.

In the third exemplary embodiment (FIG. 5), the inner body 54 cannot be rotated relative to the outer body 52, but rather can be displaced in the radial direction. In the third exemplary embodiment, as well, the outer body 52 is configured as a slide that can be displaced in the axial direction and has two journals that lie diametrically opposite one another and project radially inward, and are not shown in detail in FIG. 5, which journals engage into guide motion links in the inner body 54. The guide motion links are disposed at an acute angle relative to the longitudinal center axis 46, so that displacement of the journals in the axial direction brings about displacement of the inner body 54. As was already true for the second exemplary embodiment, the rotational movement is transferred to the eccentric by way of a rotor shaft 80 that accommodates the outer body 52, which shaft is connected with an inner shaft 82. The inner body 54 rests on a step 84 of the inner shaft 82.

In the fourth exemplary embodiment (FIG. 6), as well, the inner body 54 is displaceable relative to the outer body 52. The outer body 52, which simultaneously represents the rotor shaft 80, is provided with a guide channel 86, the center axis 88 of which is inclined about an acute angle β relative to the longitudinal center axis 46. The guide channel 86 runs at a slant from the top right to the bottom left in FIG. 6. The inner body 54 is accommodated in the channel, which body in turn is connected with the application tube 16 in displacement-proof manner. A movement of the application tube 16 in the axial direction therefore results in a movement of the inner body 54 in the axial direction and in a displacement of the inner body 54 in the guide channel 86, on the inner wall 90 of which channel the inner body 54 lies with a spherical contact surface 92.

In summary, the following should be stated: The invention relates to an apparatus 10 for application of a viscous material, having an application tube 16 that has a material inlet opening 18 at a first end 20 and a material outlet opening 24 at a second end 26, delimits an application channel 14, and is flexible at least over a part of its length, having a housing 12 that accommodates the application tube 16 and has a material feed connector 28 for the viscous material to the application tube 16, wherein the application tube 16 is connected with the housing 12 in an initial region 30 that proceeds from the material inlet opening 18 and is disposed at a distance from the housing 12 in an end region 32 that extends to the material outlet opening 24, and wherein a mounting section 48 of the end region 32 is mounted close to the material outlet opening 24, in a motor-driven eccentric 50 that can rotate about the longitudinal center axis 46. According to the invention, an adjustment mechanism for adjustment of the distance of the mounting section 48 from the longitudinal center axis 46 is provided.

The invention claimed is:

1. Apparatus for application of a viscous material, the apparatus comprising:

an application tube that has a material inlet opening at a first end and a material outlet opening at a second end, delimits an application channel, and is flexible at least over a part of its length, a housing that accommodates the application tube and has a material feed connector for the viscous material to the application tube, and a motor-driven eccentric that can rotate about a longitudinal center axis, wherein the application tube is connected with the housing in an initial region that proceeds from the material inlet opening and is disposed at a distance from the housing in an end region that extends to the material outlet opening, wherein a mounting section of the end region is mounted close to the material outlet opening, in the motor-driven eccentric, wherein the motor-driven eccentric is configured to adjust a distance of the mounting section from the longitudinal center axis, wherein the motor-driven eccentric has an outer body that can rotate about the longitudinal center axis, wherein the eccentric also has an inner body accommodated in the outer body, wherein the mounting section is mounted in the inner body via a pivot bearing, and wherein the inner body can be moved with reference to the outer body.

2. Apparatus according to claim 1, wherein the inner body can be moved between two end positions with reference to the outer body, which positions define a minimally and a maximally eccentric position of the mounting section with reference to the longitudinal center axis.

3. Apparatus according to claim 1, wherein the outer body has a center, and wherein the inner body is accommodated in the outer body, outside of the center of the outer body, and can rotate with reference to the outer body.

4. Apparatus according to claim 3, wherein the motor-driven eccentric has a rotation mechanism for rotation of the inner body with reference to the outer body, which mechanism has a journal that is guided in a guide motion link and projects radially, and wherein the guide motion link essentially has the form of a spiral section.

5. Apparatus according to claim 4, wherein the journal is firmly connected with the inner body, and wherein the guide motion link is disposed in the outer body.

6. Apparatus according to claim 3, wherein the inner body can be rotated relative to the outer body about an axis of rotation having a distance from the longitudinal center axis that is equal to its distance from the center axis of the mounting section.

7. Apparatus according to claim 1, wherein the inner body can be linearly displaced relative to the outer body in a direction transverse to the longitudinal center axis.

8. Apparatus according to claim 7, wherein the outer body has a guide channel inclined at an acute angle relative to the longitudinal center axis, in which channel the inner body is accommodated.

9. Apparatus according to claim 7, wherein the motor-driven eccentric has a displacement mechanism for displacement of the inner body with reference to the outer body, which displacement mechanism has a journal that is guided in a guide motion link and extends radially, and wherein the guide motion link is inclined at an acute angle relative to the longitudinal center axis.

10. Apparatus according to claim 1, wherein the application tube is accommodated in the inner body so as to be axially non-displaceable and in the housing with limited axial displaceability.

11. Apparatus according to claim 1, further comprising a ring groove that runs around the application tube and extends for a certain distance in the longitudinal direction of the application tube, which ring groove opens into a transverse bore that leads to the application channel and into which ring groove the material feed connector empties.

12. Apparatus according to claim 10, wherein the ring groove extends over a length of the application tube that is greater than a displacement path by which the application tube is displaceable.

13. Apparatus according to claim 4, wherein the guide motion link or the journal is disposed in a slide that can be displaced parallel to the longitudinal center axis.

14. Apparatus according to claim 1, wherein the pivot bearing is a ball bearing.

15. Apparatus according to claim 14, wherein the pivot bearing has an inner ring firmly connected with the application tube, wherein the pivot bearing has an outer ring firmly connected with the inner body, and wherein, between the inner ring and the outer ring, rings balls are disposed.

16. Apparatus according to claim 1, wherein at least a part of the initial region of the application tube is accommodated in a guide sleeve accommodated in the housing in torque-proof manner and connected with the guide sleeve.

17. Apparatus according to claim 16, wherein the guide sleeve extends at least a certain distance along the end region and is disposed radially at a distance from this region.

18. Apparatus according to claim 17, wherein an inside diameter of the guide sleeve increases continuously in a transition region between the initial region and the end region.

* * * * *